US009027292B2

(12) United States Patent
O'Neill et al.

(10) Patent No.: US 9,027,292 B2
(45) Date of Patent: May 12, 2015

(54) PASSIVE COLLIMATING SKYLIGHT

(71) Applicant: Entech Solar, Inc., Grapevine, TX (US)

(72) Inventors: Mark J. O'Neill, Fort Worth Keller, TX (US); David Gelbaum, Cosa Mesa, TX (US); Almus J. McDanal, III, Emory, TX (US); Don H. Spears, The Colony, TX (US)

(73) Assignee: Entech Solar, Inc., Fort Worth, TX (US)

( * ) Notice: Subject to any disclaimer, the term of this patent is extended or adjusted under 35 U.S.C. 154(b) by 0 days.

(21) Appl. No.: 14/059,695

(22) Filed: Oct. 22, 2013

(65) Prior Publication Data

US 2014/0047784 A1 Feb. 20, 2014

Related U.S. Application Data

(62) Division of application No. 13/097,564, filed on Apr. 29, 2011, now abandoned.

(51) Int. Cl.
*E04B 7/18* (2006.01)
*E04D 13/03* (2006.01)

(52) U.S. Cl.
CPC ..... *E04D 13/033* (2013.01); *E04D 13/03* (2013.01); *E04D 13/0335* (2013.01); *E04D 2013/0345* (2013.01)

(58) Field of Classification Search
CPC ..... E04D 13/03; E04D 13/033
USPC ..... 52/200, 173.3
See application file for complete search history.

(56) References Cited

U.S. PATENT DOCUMENTS

| | | | |
|---|---|---|---|
| 191,802 | A | 6/1877 | Howard |
| 3,511,559 | A | 7/1967 | Foster |
| 3,350,819 | A | 11/1967 | Polidoro |
| 3,839,949 | A | 10/1974 | Gobel |
| 4,339,900 | A | 7/1982 | Freeman |
| 4,733,505 | A | 3/1988 | Van Dame |
| 4,809,468 | A | 3/1989 | Bareiss |
| 5,502,935 | A | 4/1996 | Demmer |
| 5,528,471 | A | 6/1996 | O'Green |

(Continued)

FOREIGN PATENT DOCUMENTS

| | | |
|---|---|---|
| DE | 2142873 | 3/1973 |
| EP | 0628676 | 12/1994 |

(Continued)

*Primary Examiner* — Basil Katcheves
(74) *Attorney, Agent, or Firm* — Duane Morris LLP

(57) ABSTRACT

A passive collimating skylight system includes an energy-receiving aperture defining a first plane and an energy-delivering aperture defining a second plane that is spaced apart from and non-parallel to the first plane. An energy-directing passageway extends between the energy-receiving aperture and the energy-delivering aperture to redirect radiant energy incident on the energy-collecting aperture over a range of incidence angles to the energy-delivering aperture so that the redirected radiant energy emerges from the energy-delivering aperture over a range of emergence angles that is smaller than the range of incidence angles. The passageway is defined by a wall having a first end that defines the energy-delivering aperture and a second end that defines the energy-collecting aperture, the wall tapering inwardly and having a reflective inner surface along substantially the entire length from the first end to the second end. At least a portion of the wall of the passageway can be made of a flexible reflective film.

1 Claim, 6 Drawing Sheets

(56) References Cited

U.S. PATENT DOCUMENTS

| | | | | |
|---|---|---|---|---|
| 5,546,712 | A | 8/1996 | Bixby | |
| 5,613,333 | A | 3/1997 | Witzig, Jr. | |
| 5,655,339 | A | 8/1997 | DeBlock | |
| 5,729,387 | A | 3/1998 | Takahashi | |
| 6,035,593 | A | 3/2000 | Chao | |
| 6,219,977 | B1 * | 4/2001 | Chao et al. | 52/200 |
| 6,363,667 | B2 | 4/2002 | O'Neill | |
| 6,918,216 | B2 * | 7/2005 | Hoy et al. | 52/200 |
| 7,639,423 | B2 | 12/2009 | Kinney et al. | |
| 7,957,065 | B2 * | 6/2011 | Jaster | 359/592 |
| 8,098,434 | B1 * | 1/2012 | Hoffend et al. | 359/591 |
| 8,371,078 | B2 * | 2/2013 | Jaster | 52/200 |
| 2005/0166490 | A1 * | 8/2005 | Darmer et al. | 52/200 |
| 2007/0044833 | A1 | 3/2007 | Chern | |
| 2009/0205699 | A1 | 8/2009 | Chang | |
| 2010/0309556 | A1 * | 12/2010 | Jaster | 359/593 |

FOREIGN PATENT DOCUMENTS

| | | |
|---|---|---|
| FR | 2637929 | 4/1990 |
| JP | 4323451 | 11/1992 |
| SU | 647424 | 2/1979 |
| WO | 9406979 | 3/1994 |

* cited by examiner

PASSIVE COLLIMATING SKYLIGHT

RELATED APPLICATIONS

The present application is a divisional of and claims priority benefit of U.S. application Ser. No. 13/097,564 entitled "Passive Collimating Skylight" filed 29 Apr. 2011, of which is hereby incorporated herein by reference in its entirety.

FIELD OF THE INVENTION

The present invention relates generally to skylights and more particularly to passive collimating skylights.

BACKGROUND

Large warehouses and retail buildings often use passive skylighting systems as a low cost option to illuminate the interior spaces. As compared to active skylighting systems, passive systems have no moving parts, such as sun-tracking reflectors or lenses. Due in part to their passive nature, many conventional passive skylighting systems cannot provide consistent lighting conditions either throughout the year or throughout the day since the ability of these skylight systems to illuminate an interior space is highly dependent on the angle of the sun. Consequently, the illumination area beneath the skylight moves throughout the day and the year as the sun moves overhead. In addition, conventional passive skylighting systems also do not efficiently deliver light to the desired location due to their inability to redirect and distribute incident rays of solar radiation in an efficient manner.

BRIEF DESCRIPTION OF THE DRAWING

The present invention is best understood from the following detailed description when read in conjunction with the accompanying drawing. It is emphasized that, according to common practice, the various features of the drawing are not necessarily to scale. On the contrary, the dimensions of the various features are arbitrarily expanded or reduced for clarity. Like numerals denote like features throughout the specification and drawing.

DETAILED DESCRIPTION

Passive skylight systems are popular lighting choices in many commercial and retail buildings due to their low cost and energy efficiency. Passive collimating skylights provide vast improvements over standard passive skylights due to their ability to deliver light to a particular location within a room, regardless of the angle of incidence of rays of solar radiation incident on the energy-collecting aperture. With today's emphasis on energy conservation, the use of passive collimating skylights that are low cost and which can provide reliable and effective illumination in warehouses, office buildings and other commercial and retail structures is quickly becoming an increasingly attractive lighting option.

In general, a passive collimating skylight includes a radiant energy-collecting aperture to collect lights rays, a radiant energy-delivering aperture to distribute the collected light to illuminate a desired location, and a radiant energy directing passageway extending between the collecting and delivering apertures to collimate the radiant energy while it is being transferred between apertures so that light is consistently delivered to a desired location beneath the skylight. The structure and features of an exemplary passive collimating skylight are described in detail in U.S. Pat. No. 6,363,667. The present application expands on and provides additional advantages to those provided by the skylight system described in U.S. Pat. No. 6,363,667. Other passive collimating skylight systems also may take advantage from the features and benefits of the systems described herein.

Figure 1A:
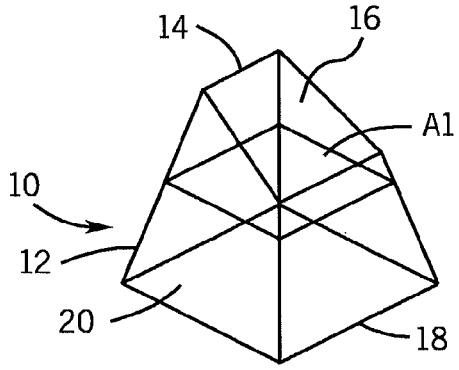
FIG. 1A is a perspective view of an exemplary tapered collimating passageway that can be used in a skylight system, according to an illustrative embodiment.
Figure 1B:
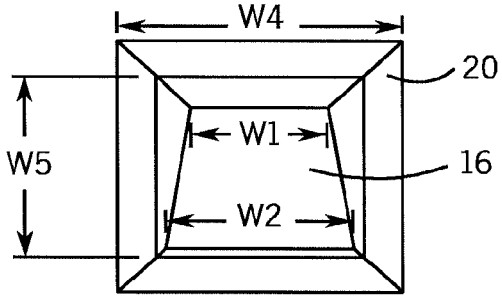
FIG. 1B is a bottom plan view of the passageway of FIG. 1A.
Figure 1C:
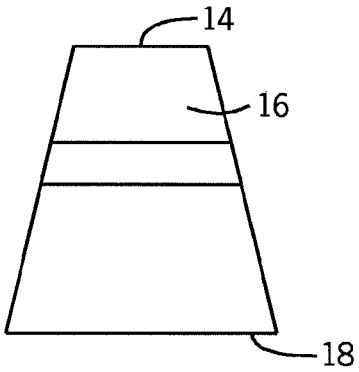
FIG. 1C is a front side view of the passageway of FIG. 1A.
Figure 1D:
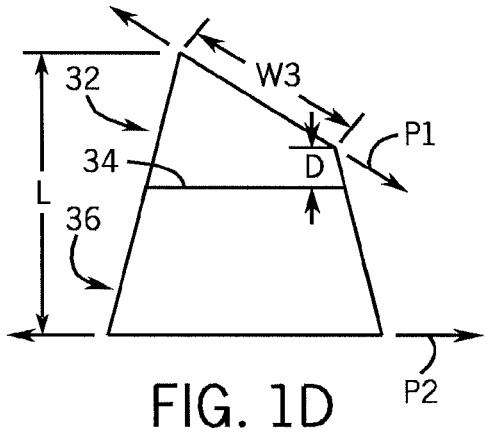
FIG. 1D is a side view of the passageway of FIG. 1A.

Referring now to FIGS. 1A, 1B, 1C and 1D, an exemplary embodiment of an energy directing passageway 10 for a passive collimating skylight system is shown. FIG. 1A is a perspective view of the passageway 10; FIG. 1B is a bottom plan view of the passageway 10; FIG. 1C is a front side view of the passageway 10 as seen from the front of FIG. 1A; and FIG. 1D is a side view of the passageway 10 as viewed from the side of FIG. 1A. As can be seen in this example, the energy directing passageway 10 is defined by a wall 12 that tapers inwardly substantially continuously from a first end 18 that terminates at and defines an energy-delivering aperture 20 to a second end 14 that terminates at and defines an energy-collecting aperture 16. In certain embodiments, substantial illumination advantages may be attained by configuring the passageway 10 so that the area A1 of the energy-collecting aperture 16 is at least 15% smaller than the area of the energy-delivering aperture 20. Substantial illumination advantages also may be attained by configuring the passageway 10 so that the longest length L of the tapered passageway 10 is larger than 60% of the smallest extent W1 (e.g., width or diameter) of the energy-collecting aperture 16. While these relative dimensions can provide substantial advantages with respect to consistently and efficiently illuminating an interior space, skylight systems that are configured with different relative dimensions may also benefit from the features of the passive collimating skylight systems described herein. One of these features is the angular placement of the energy-collecting aperture 16 relative to the energy-delivering aperture 20 so that the wall 12 of the energy-directing passageway 10 tapers outwardly for substantially the entire length between the apertures 16 and 20. As a result, collimation of light incident on the aperture 20 begins immediately upon receipt. Other features include forming all or a portion of the collimating passageway 10 from a lightweight, flexible reflective film and including an end support system to exert a pulling force on the film to maintain the position and shape of the flexible collimating passageway 10 when installed.

Figure 2:
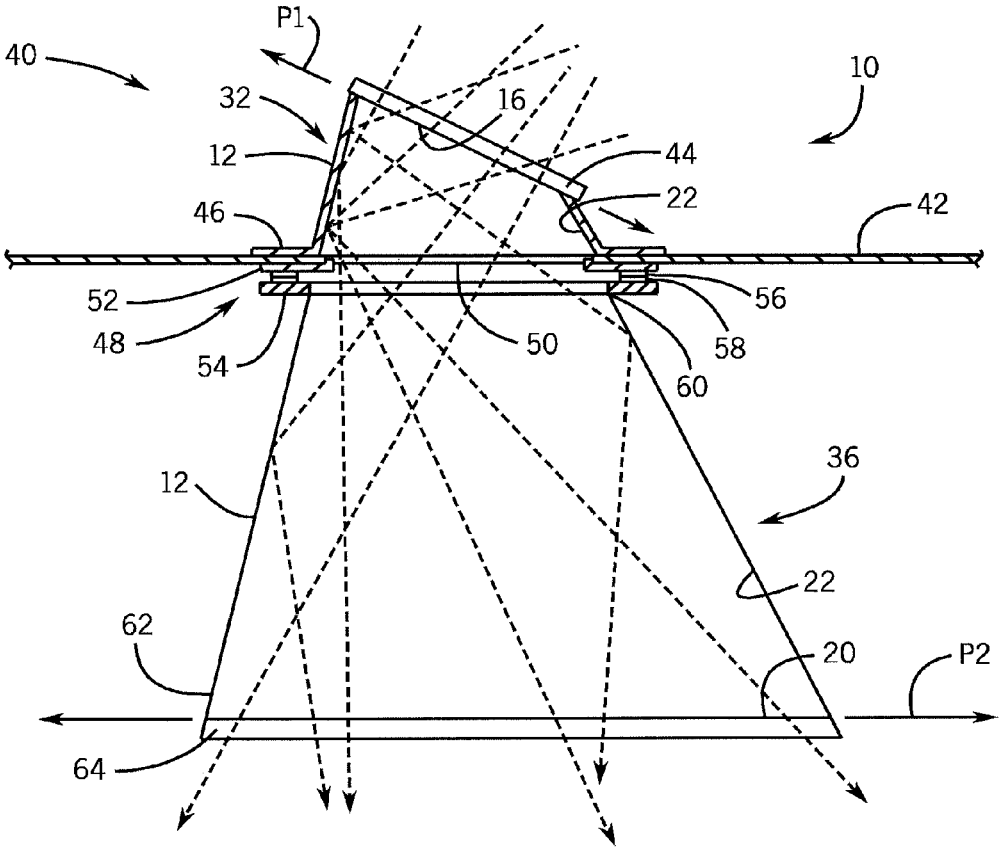
FIG. 2 is a schematic cross-sectional representation of an exemplary skylight system installed through a roof, in accordance with an illustrative embodiment.

More particularly, with reference to FIG. 1D and FIG. 2, the energy-collecting aperture 16 of the passageway 10 defines a plane P1 and the energy-delivering aperture 20 defines a plane P2. The planes P1 and P2 are spaced apart and at an angle relative to one another. When the skylight system is deployed in a typical installation, plane P2 is typically within approximately +/−10 degrees of the local horizontal plane, and plane P1 intersects the plane P2 at an angle that is typically within a range of approximately +/−30 degrees of the local latitude angle. As an example, for a local latitude angle of 35 degrees, the angle between planes P1 and P2 will typically lie in the range of approximately 5 degrees to 65 degrees. As further shown, the wall 12 of the passageway 10 tapers substantially continuously along the entire distance between aperture 20 and aperture 16 so that the light that is received by the aperture 16 is subject to collimation in the tapered passageway 10 immediately upon receipt. Consequently, the number of reflections experienced by the light incident on the aperture 16 prior to exiting the aperture 20 is minimized, thus increasing the illumination efficiency of the skylight system.

To illustrate, in FIG. 2, the light incident on the energy-collecting aperture 16 is represented by dashed lines which further show the manner in which the received light is redirected in the passageway 10 and exits the energy-delivering aperture 20. In the example shown, the light can be received over a wide range of incidence angles relative to the plane P1 (i.e., from 0 to 90 degrees depending on the angle of the sun) and is collimated in the passageway 10 immediately upon receipt so that substantially all of the received light is delivered to the energy-delivering aperture 20 where it exits at angles that are typically less than 45 degrees relative to the plane P2. In the embodiment shown in FIGS. 1A-1D, the tapered passageway 10 has a square or rectangular lateral cross section, thus having a pyramidal shape extending between a trapezoidal aperture 16 and a square or rectangular aperture 20. It should be understood, however, that the tapered passageway 10 need not have a rectangular cross-section and that the lateral cross-section may have any of a variety of shapes, such as other multi-sided shapes or oval or circular shapes, and that the wall 12 of the tapered passageway 10 need not be flat (as shown) but may include convex or concave surfaces.

The angle of the energy-collecting aperture 16 in the plane P1 relative to the plane P2 of the energy-delivering aperture 20 can be any angle within a range of 0 degrees to 90 degrees, and preferably less than 60 degrees. In some embodiments, the angle of the plane P1 relative to the plane P2 is selected based on the general geographic location of the building in which the skylight system will be installed. In certain implementations of the skylight system, the angle is selected so that, when installed in a building, the energy-collecting aperture 16 is tilted towards the equator by an angle that is approximately equal to the local latitude angle +/−30 degrees to maximize sunlight collection throughout the year.

Figure 3:
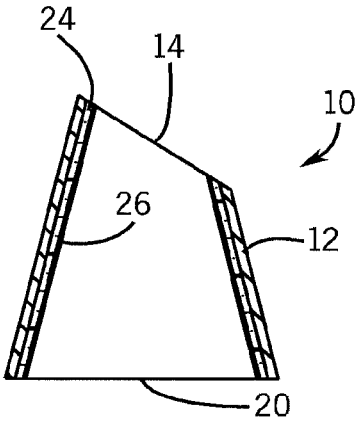
FIG. 3 is a schematic cross-sectional representation of an exemplary configuration of the passageway of FIGS. 1A-1D, according to an illustrative embodiment.
Figure 4:
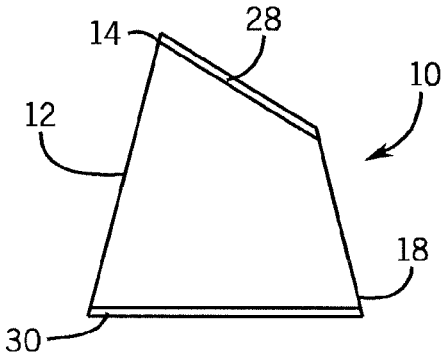
FIG. 4 is a side view of an exemplary configuration of a tapered collimating passageway, according to an illustrative embodiment.

Returning to FIG. 2, the wall 12 of the tapered passageway 10 includes a specularly reflective inner surface 22. In an exemplary implementation of the skylight system, the wall 12 is made of sheet metal having an inner mirrored, silvered or aluminized surface. One example of a suitable sheet metal material is an Alanod MIRO—SILVER® reflector. In other implementations, cost savings can be realized by eliminating the specularly reflective sheet metal material and using a reflective lightweight material, such as a metalized polymer film (e.g., aluminized polyester, such as DuPont MYLAR®), to provide the reflective inner surface 22. For instance, the film may be attached to the inner surface of an outer wall layer that is made of a more rigid material, such as sheet metal, polyurethane or polystyrene foam (e.g., Styrofoam®), wood, etc. The film may be attached to the outer wall layer by any suitable attachment medium, such as by an adhesive, a bonding agent, tape, staples, etc. Aluminized polyester film is a particularly attractive material as it results in delivery of a more pleasing "white" light to the illumination area as compared to the "yellow" light provided by a silvered surface. To prolong the lifetime of the aluminum layer on the aluminized polyester, a transparent overcoat of clear polymer can be applied over the aluminum during the metalized film manufacture. In other implementations, such as the example shown in the schematic cross-section of FIG. 3, the sheet metal wall 12 can be insulated with an insulating material 24 (e.g., polyurethane or polystyrene foam) and the metalized film 26 can be adhered to the inner surface of the insulating material 24. The thermal insulation provides additional benefits in terms of minimizing heat gain or heat loss between the building and the outside environment, as well as minimizing condensation inside the skylight.

Employing a rigid or semi-rigid material (e.g., sheet metal, polystyrene foam, etc.) for at least a portion of the wall 12 of the tapered passageway 10 may be particularly advantageous in installations, or in certain areas of the installation (e.g., outdoors), where some degree of structural support or weather-proofing is desired. However, if structural support or weather-proofing is not a concern, e.g., under the roof deck inside the building, then further savings in cost and weight can be realized by eliminating part or all of the rigid or semi-rigid layers of the wall 12 material. Accordingly, in various implementations, the wall 12 of the tapered passageway 10 can include only a single layer that is made of a lightweight, reflective, flexible material that has sufficient strength to resist tearing. An example of such a reflective material is a metalized polymer film, such as an aluminized polyester film (e.g., aluminized MYLAR®).

In such implementations, the end of the film at the energy collecting end 14 of the tapered passageway 10 can be connected to an upper end support structure 28, such as a frame, that defines the energy-collecting aperture 16. The end of the film at the energy-delivering end 18 of the tapered passageway 10 can be connected to a lower end support structure 30 that stretches or pulls the film to maintain the position and shape of the passageway 10 when the skylight system is installed in a building. The lower end support 30 can be provided by a frame that defines the light-delivering aperture 20 and which is sufficiently weighted to exert a pulling force on the film that is directed from the light-receiving end 14 of the passageway 10 towards the light-delivering end 16 of the passageway 10. In some embodiments, the lower end support 30 can be a luminaire or other light delivery or diffuser structure that is attached to the tapered passageway 10 at the energy delivering end 18. The ends of the film can be attached to the end support structures 28, 30 by any suitable attachment system, such as by retention hardware, adhesives, glues, bonding compounds, tape, etc.

In other embodiments, one portion of the tapered passageway 10 may be made of the flexible film, while another portion of the tapered passageway 10 can be provided with structural rigidity or support. For instance, the skylight system can include a dome portion that extends above a roof line of a building and which includes the energy-collecting aperture 16 to receive the radiant energy from the sun's rays. Typically, a transparent or translucent material which is resistant to breakage (e.g., a window 44 in FIG. 2) is supported by the dome portion so that the energy-collecting aperture 16 is covered. Because the dome portion must have sufficient strength to support the aperture-covering material and is exposed to the outdoor elements, the dome portion is provided with structural rigidity and sealed to prevent infiltration of dust and moisture. The dome portion of the passageway 10 is shown generally by reference numeral 32 in FIG. 1D. Although FIG. 1D shows a line 34 separating the dome portion 32 and a remaining portion 36 of the passageway 10, the line 34 is intended for illustrative purposes only to show the approximate position of a roof line when the passageway 10 is installed in building. In some embodiments, the tapered passageway 10 may include a physically separate dome portion 32 that is coupled to the remaining portion 36 of the passageway 10 generally in the vicinity of the line 34, while in other embodiments the dome portion 32 and the remaining portion(s) 36 may not be physically separate portions.

An illustrative example of an embodiment of a tapered passageway 10 that does include a physically separate dome portion 32 is shown in the schematic cross-section of a skylighting system 40 installed through a roof 42 of a building. When the system 40 is installed, the tapered dome portion 32 of the passageway 10 is above the roof line 42 of the building so that it is exposed to the outside environment. In this embodiment, the wall 12 of the exterior dome portion 32 of the tapered passageway 10 is made of a sheet metal (e.g., anodized aluminum or galvanized steel), while the wall 12 of the portion 36 of the tapered passageway 10 that is in the interior of the building is made of metalized polyester film that is subjected to a stretching or pulling force so that the passageway 10 can maintain its position and shape. In other embodiments, the wall 12 of the interior portion 36 may also include an outer layer, such as plywood or polystyrene or polyurethane foam, that supports a layer of flexible, metalized film. By providing a tapered dome portion 32 of the passageway 10 above the roof line 42 that has a reflective inner surface, collimation of the radiant energy incident on the dome window 44 begins immediately upon collection above the roof line 42, resulting in increased efficiency with respect to the amount of collected light that is ultimately delivered to the illumination area.

For instance, for a surface having a reflectivity on the order of 85%, each reflection results in a 15% loss of radiant energy. By starting the collimation immediately upon receipt, fewer reflections of the incident solar rays are encountered in delivering the collimated light to the desired location and, consequently, the overall loss of energy can be significantly reduced. In addition, by starting the collimation above the roof, the length of the interior portion 36 of the collimating passageway 10 can be reduced, thus facilitating installation and minimizing structural intrusion into the usable interior volume of the building. The reduced length of the interior collimator portion 36 can be a significant benefit in buildings that use all available vertical space, such as warehouses and retail stores with tall shelving. In an exemplary installation, the length of the interior portion 36 extends at least to, but not far beyond, the bottom of the roof joists of the building. In this manner, both loss of light exiting the energy-delivering aperture 20 of the portion 36 of the passageway 10 due to incidence on the roof joists and intrusion into the useable interior volume of building are minimized.

The exterior dome portion 32 and the inner portion 36 of the tapered passageway 10 can be coupled together in a variety of manners. In an exemplary installation, the exterior dome portion 32 includes a bottom edge 46 that is flared. The flared edge 46 may be attached to the roof surface 42 by suitable attachment means, such as screws or adhesives. The flared edge 46 may also function as a "flashing" that can later be covered with an appropriate roofing material (e.g., a polymer membrane for a commercial roof) to prevent entry of moisture through the roof via the dome portion 32. In other installations, the dome portion 32 may extend through the roofing material and be attached to the roof support structure (e.g., steel joists and decking material) and the roof penetration sealed by any suitable attachment and sealing means.

In the exemplary installation of the system 40 in FIG. 2, the dome portion 32 is installed from the roof 42, and the remaining portion 36 of the tapered passageway 10 is made of a reflective, flexible film that is installed from the interior of the building. The dome portion 32 and remaining portion 36 are coupled together via a fastening system 48. In this example, the fastening system 48 includes a roof mounting frame 52, which extends about a roof opening 50, and fasteners 56 and 58 by which the roof mounting frame 52 attaches to an upper end support 54 of the flexible portion 36 of the tapered passageway 10. For instance, the roof mounting frame 52 can be a metal flashing that extends through and/or defines the opening 50. The mounting frame 52 can be provided with the fastener 56 which engages with the complementary fastener 58 that is provided with the passageway upper support 54. The fastener 56 and complementary fastener 58 of the fastening system 48 can include any of a variety of fastening structures and materials, such as hooks that engage with eyes, hooks that engage with rods or loops, latches, hook and loop fastening systems (e.g., Velcro®), adhesives, etc. In some embodiments, the fastening system 48 is structured so that the upper end support 54 of the passageway 10 automatically engages with and is secured to the roof mounting frame 52 when the frame 52 and the support 54 are brought into contact.

By way of illustrative example and referring again to FIG. 2, the wall 12 of the inside portion 36 of the tapered passageway 10 is made of a flexible, specularly reflective material (e.g., aluminized polyester film) having an upper end 60 connected to the frame 54 or other support structure that defines an upper aperture of the portion 36. Similarly, a lower end 62 of the film can be connected to a rod, frame or other support structure 64, including to a luminaire or diffuser assembly. The flexible material and end supports 54, 64 can then be folded up for delivery to the site of installation. The tapered passageway portion 36 can be installed by hoisting the upper support 54 towards the roof 42 with strings or cords so that the upper support 54 connects with the roof frame 52 via the fastening system 48. Once connected, the lower end support 64 of the flexible passageway portion 36 provides a sufficient downward pulling force to maintain the position and shape of the passageway portion 36.

In this example, installation of the skylight system can then proceed from the roof level. In some installations, a thin high-strength transparent film (such as Tefzel) (not shown) is placed over the hole 50 that has been formed in the roof 42 to provide thermal insulation, a vapor barrier, and a second line of defense for fall protection. Next, the metal sided dome portion 32 of the tapered passageway 10 is placed over the hole 50. In embodiments in which the dome portion 32 includes a flared bottom peripheral edge 46, the flared edge or flange 46 is attached to the roof deck, such as by screws. To complete the installation, a roof membrane is installed over the flashing surface 46 of the dome portion 32 to minimize water leakage into the building.

Figure 11:
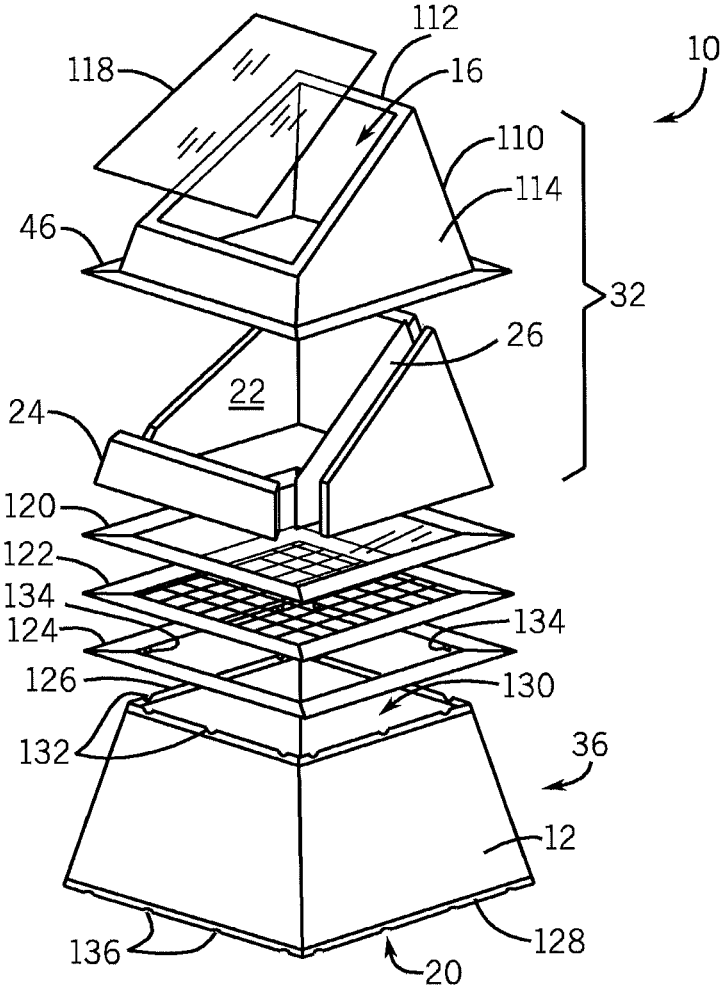
FIG. 11 shows an exploded view of an exemplary skylight system, according to an illustrative embodiment.

The exploded view of FIG. 11 shows the detail of another exemplary implementation of a skylight arrangement having a collimating passageway 10 that includes a pyramidal-shaped dome portion 32 that is physically separate from the remaining portion 36 of the passageway 10. In this example, the dome portion 32 includes an exterior wall layer 110 made of sheet metal or other material that is suited to exposure to an outdoor environment. The exterior wall layer 110 continuously angles outwardly from an upper edge 112 that defines the trapezoidal-shaped energy-collecting aperture 16 to a lower edge 114 that terminates at the flange 46. The flange 46 provides for a structurally strong and weather-tight attachment to the roof support below and the roof membrane above the flange 46. A window 118 made of a material having a diffusing surface covers the aperture 16 and may be secured to the dome portion 32 with a sealant material, which can be any suitable outdoor sealant. The interior of the dome portion 32 is lined with a thermal insulating foam material 24. An aluminized polyester film 26 is bonded to the inner surface of the foam layer 24 to provide the reflective collimation surface 22. A lower diffuser 120 closes out the dome portion 32 proximate the flange 46, thereby enclosing a small volume of air inside the dome 32 to provide thermal resistance to the flow of heat from the building to the outside environment. The bottom diffuser 120 also provides a condensation barrier to prevent droplets of water which may form in very cold weather on the top window 118 from falling into the building below. Ideally, the bottom diffuser supporting frame comprises at least one layer of non-metallic material (e.g., a polymer gasket) to form a thermal break between the potentially cold metal surface of the dome 46 and the potentially humid interior air inside the building, thereby further minimizing condensation problems. Yet further, the bottom diffuser 120 can prevent falling shards should the top window 118 suffer damage. In systems in which fall protection or intrusion prevention are desired, a grid 122 or other structure can be added at the bottom of the dome 32, or alternatively at the top of the dome under the window 118. The arrangement in FIG. 11 also includes a support structure 124 for supporting and attaching to the portion 36 of the passageway 10. In this example, the wall 12 of the portion 36 of the collimating passageway 10 is made of a metalized polymer film that extends between a top end support 126 and a bottom end support 128. The top support 126 defines the upper light-receiving opening 130 of the portion 36 and includes slots or apertures 132 configured to engage with hooks or latches 134 that are part of the roof support frame 124. The lower end support 128 may be made of any material that is adequately weighted so that the gravitational force is sufficient to stretch the wall 12 of the portion 36 to maintain the position and shape of the passageway 10. As an example, the lower end support 128 may be made of fiberglass rods that are secured to the wall 12 of the portion 36. The lower end support 128 also may include slots or apertures 136 so that a tubular extension may be secured to and hung from the collimating passageway 10, if desired, to further direct and deliver the light to a specific location at some vertical distance below the below the lower end support 128.

Figure 5:
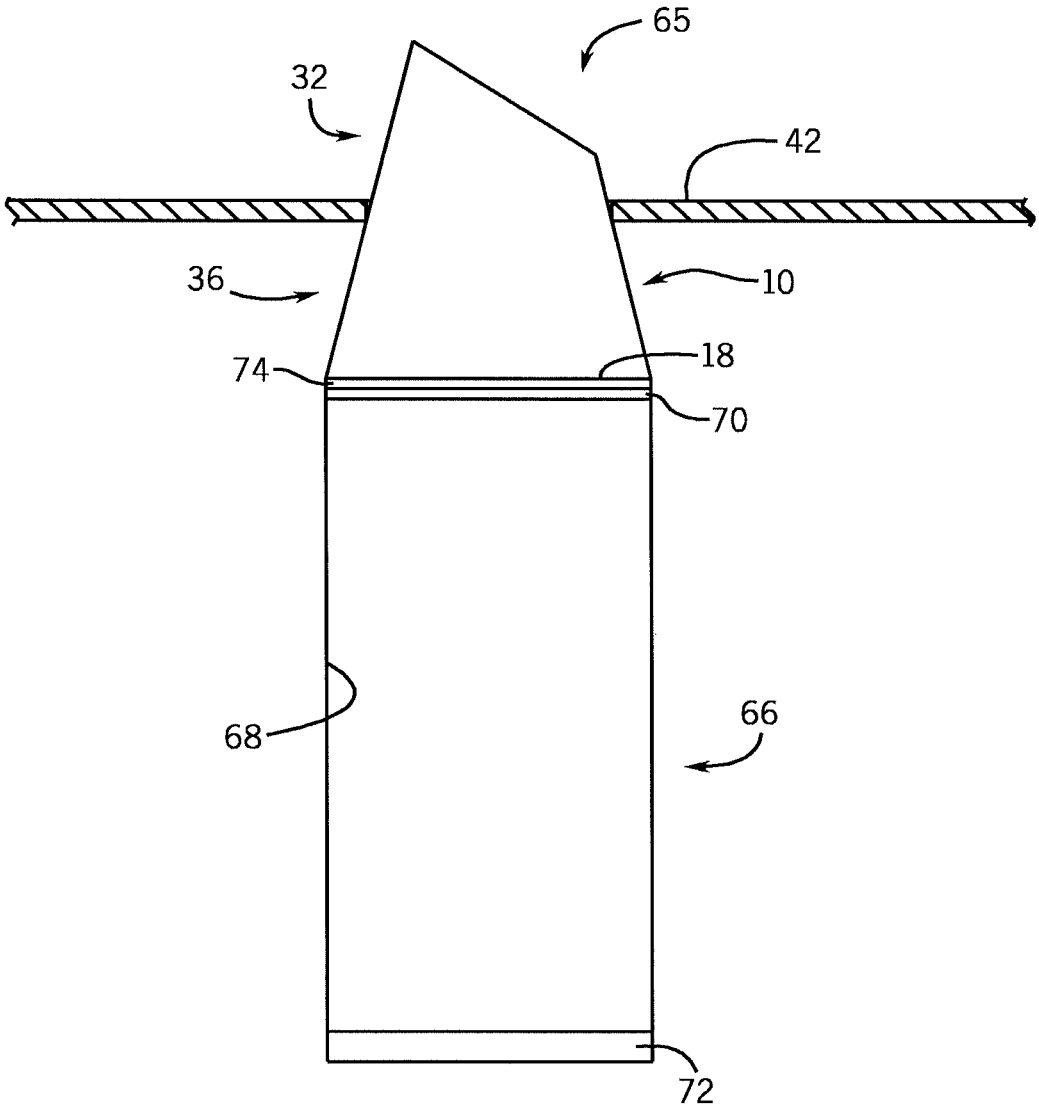
FIG. 5 is a schematic representation of an exemplary passive collimating skylight system installed through the roof of a building, according to an illustrative embodiment.

As an example, in some installations and as shown in the schematic representation of a skylight system 65 in FIG. 5, the passive collimating skylight system may further include a tubular extension 66 coupled to the energy-delivering end 18 of the tapered passageway 10 to deliver the light to a lower location in the building. For instance, in a high-ceilinged warehouse, a more concentrated region of illumination may be desired below the skylight and the tubular extension 66 can be used to deliver the light to the desired region. Alternatively, the building may include a drop ceiling that is suspended at a large distance below the roof 42. In this case, the tubular extension 66 can extend between the energy-delivering end 18 of the tapered passageway 10 to an opening formed in the ceiling in which a luminaire is present.

The tubular extension 66 may be made of any suitable material that has an inner surface 68 that is specularly reflective. For instance, the extension 66 can be made of sheet metal with an inner surface that is silvered or otherwise covered by a specularly reflective coating or material, such as the aluminized polyester film discussed above. In other implementations, the tubular extension 66 can be made entirely of a reflective film extending between support structures 70, 72 that exert a stretching or pulling force between the two ends of the extension 66. In some embodiments, the upper support structure 70 of the tubular extension 66 can be a frame that fastens to a lower frame 74 of the tapered passageway 10 and the lower support structure 72 can be a luminaire or other light diffuser having sufficient weight to exert a pulling force that maintains the position and shape of the tubular extension 66. When made of the flexible reflective material, the tubular extension 66 can be folded, delivered to, installed and connected to the tapered passageway 10 at the installation site using the same installation techniques described above with respect to the tapered passageway 10. In some implementations, the bottom end support frame 74 of the tapered passageway 10 may including a fastening system that is configured to optionally attach to either a luminaire or to the upper end support frame 70 of the tubular extension 66. The tubular extension 66 can be attached to the tapered passageway 10 prior to hoisting the passageway 10 to the roof line 42 or can be separately hoisted for connection after the tapered passageway 10 has been attached to and is suspended from the roof 42.

Figure 6:
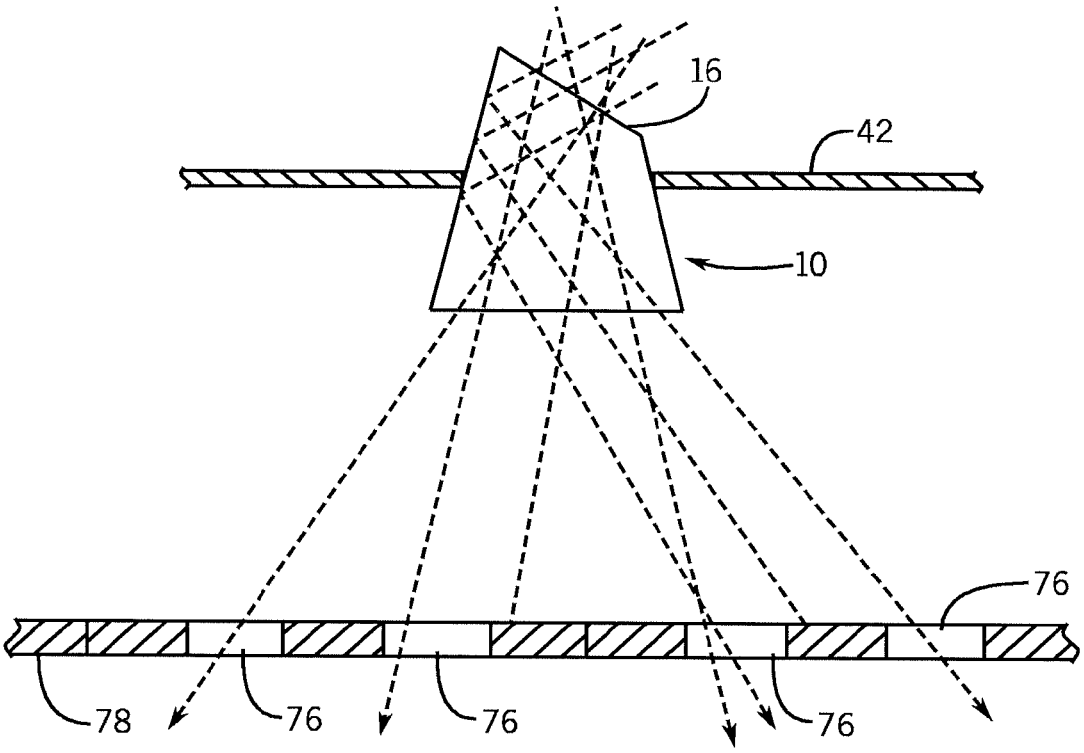
FIG. 6 is a schematic representation of another exemplary passive collimating skylight system installed through the roof of a building, according to an illustrative embodiment.

In some installations, obstructions, such as wiring and piping, above the ceiling may make it impractical to install the tubular extension 66. In such a situation, the passive collimating skylight systems described herein can still be used to effectively light an area below the ceiling. As an example and as shown schematically in FIG. 6, one or more openings can be formed through a ceiling 78 below the tapered passageway 10, such as by removing ceiling tiles, and transparent or translucent diffusing luminaires 76 may be installed in the openings. Because the tapered passageway 10 can efficiently collect light that is incident from a wide range of angles on the energy-collecting aperture 16 and can consistently redirect the collected to a desired region under the passageway 10 regardless of the angle of incidence (as represented by the dashed lines in FIG. 6), sufficient lighting can be provided to the interior spaces below the ceiling 78 through the ceiling luminaires 76.

In some buildings, it may be impractical or difficult to install any portion of the passive collimating skylight system from inside the building. However, installing the tapered passageway 10 from outside the building at the roof 42 is not an attractive alternative because the hole formed through the roof 42 must be oversized to allow for passage of the larger energy-delivering end 18 of the passageway 10. An oversized hole through the roof 42 is not particularly desirable because it can present an increased opportunity for moisture leaks through the roof 42. Accordingly, various implementations of the tapered passageway can include expandable or pop-open features that allow the tapered passageway to be installed from the roof 42 outside the building without requiring an oversized aperture through the roof 42.

Figure 7:
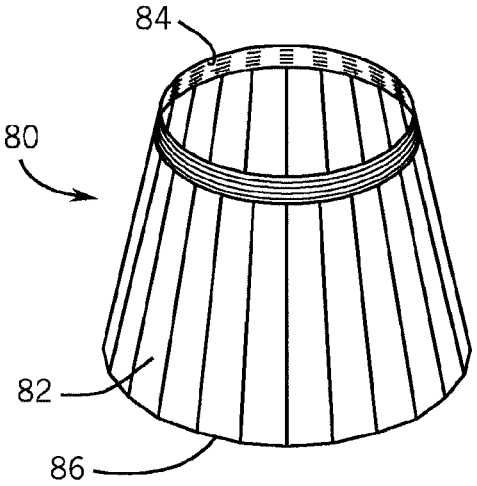
FIG. 7 shows an exemplary embodiment of a tapered collimating passageway having expandable features, according to an illustrative embodiment.
Figure 8:
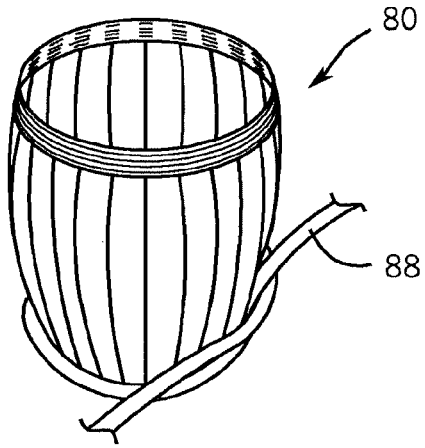
FIG. 8 shows the tapered passageway of FIG. 7 with the expandable features restricted.

Exemplary embodiments of expandable tapered passageways are shown in FIGS. 7, 8, 9 and 10. In FIGS. 7 and 8, the wall of an expandable tapered passageway 80 is formed of a plurality of flexible slats 82 that are connected at one end at the energy-collecting end 84 of the passageway 80 and which extend outwardly from their connected ends to respective free ends at the energy-delivering end 86 of the passageway 80. As shown in FIG. 8, a cord, rope, tape or other readily removable restriction means 88 is secured about the free ends of the slats 82 so as to restrict the maximum width of the energy-delivering end 86 to a size that is not substantially greater than the maximum width of the energy-collecting end 84 of the passageway 80. In this manner, the passageway 80 can be installed from outside the building by extending the restricted-width end 86 through a hole formed through the roof. Once placed at a desired position, the restriction cord 88 can be removed to free the slats 82 and allow the energy-delivering end 86 to expand. The slats can be either flat or curved in one or both directions, i.e., circumferentially or longitudinally, for added strength after expansion.

Figure 9:
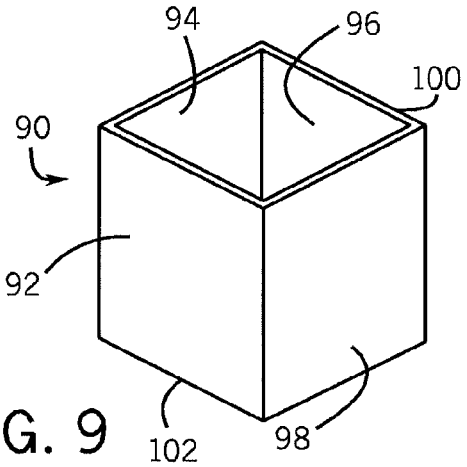
FIG. 9 shows another exemplary embodiment of a tapered collimating passageway having expandable features, where the expansion of the passageway is restricted, according to an illustrative embodiment.
Figure 10:
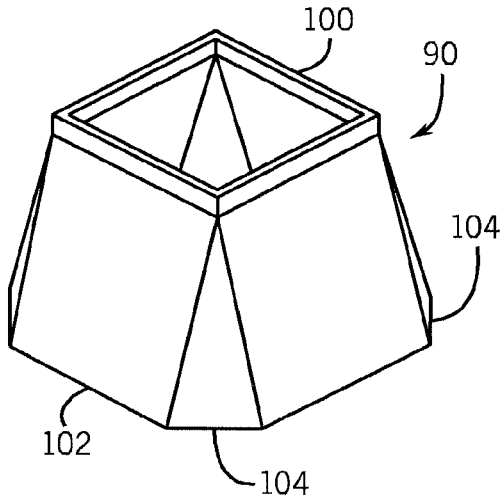
FIG. 10 shows the passageway of FIG. 9 in expanded form, according to an illustrative embodiment.

In the expandable embodiment shown in FIGS. 9 and 10, an energy-directing passageway 90 includes sheet metal walls 92, 94, 96 and 98, having specularly reflective inner surfaces. Each of the walls 92, 94, 96, 98 extends from an energy-collecting end 100 of the passageway 90 to an energy-delivering end 102 of the passageway 90. Each side is connected to adjacent sides by a flexible membrane 104. In an illustrative embodiment, the flexible membrane 104 is made of a metalized film, such as an aluminized polyester film, so that, when expanded, the entire inner surface of the tapered passageway 90 is specularly reflective. The expansion from the stowed geometry of FIG. 9 to the deployed geometry of FIG. 10 can be accomplished by using stored mechanical energy, e.g., by first forming the four walls 92, 94 96 98 to the deployed shape of FIG. 10, and then bending the four walls 92, 94, 96, 98 inward to the stowed shape of FIG. 9, and using a restricting cord or tape or other mechanical device to hold the four walls 92, 94, 96, 98 in the stowed position until installation, after which the restricting cord or tape or other mechanical device is removed, thereby producing the deployed geometry of FIG. 10.

Although not shown, it should be understood that the expandable features described above may be employed with any of a variety of configurations of the tapered passageway, including the embodiment shown in FIGS. 1A-1D having the angled energy-collecting aperture 16.

As described above, the passive skylighting system includes a tapered energy-directing passageway that extends from a tilted energy-collecting aperture and expands to an energy-delivering aperture. With reference again to FIGS. 1A-1D, the following dimensions are provided as illustrative examples only in order to demonstrate the ability of the system to illuminate an interior space and are not intended to be limiting in any manner. As a first example, the passageway 10 can be configured with a length L of 57.2 inches. The passageway 10 further includes an energy-collecting aperture 16 having an area A1 of 900 square inches, a width W1 of 23.1 inches and a width W2 of 31.2 inches. As viewed from the side in FIG. 1D, the energy-collecting aperture 16 has a width W3 of 33.1 inches. The energy-delivering aperture 20 is substantially square with a width W4 of 47.5 inches. When installed through a roof, a distance D between the roof line 34 and the bottom of the angled energy-collecting aperture 16 is 8 inches, such that the square cross section of the passageway 10 at the roof level 34 has a width W5 of 34.3 inches on each side. It has been found that a passageway 10 configured with these dimensions can deliver approximately 50,000 lumens to an interior space near solar noon on a clear day. In this particular embodiment, rays incident on the energy collecting aperture 16 having incidence angles ranging from approximately 15 to 90 degrees exit the energy-delivering aperture 20 at angles of approximately 45 degrees or less.

By way of further example only, it has been found that a passageway 10 configured with length L of 83.3 inches, area A1 of 1,900 square inches, width W1 of 33.7 inches, width W2 of 45.4 inches, width W3 of 48.2 inches, width W4 of 69.1 inches, distance D of 8 inches, and width W5 of 48.8 inches can deliver approximately 120,000 lumens to an interior space near solar noon on a clear day.

The installations described above include passive skylight systems in which the collimating skylight extends vertically downward from a roof towards the floor of a building. However, it is also contemplated that the passive collimating systems may be installed in a building in a horizontal orientation. For instance, the passive collimating skylight systems described herein may be installed in a multiple story building and may be used to illuminate interior spaces on any floor of the building. In such installations, rather than extending through the roof, the dome portion of the skylight system may extend through an aperture formed in an exterior sidewall of the building, and the energy collecting aperture is angled as appropriate to capture incident energy radiated by the sun. Within the building, the interior portion of the tapered passageway and the tubular extensions can be arranged so that they extend in a horizontal direction between the floor and ceiling of adjacent stories to a desired inside location. A tubular extension may then be routed vertically so that light is delivered to a luminaire or diffuser installed in a ceiling of an interior room. In such installations, the tapered passageway and the tubular extensions may be made of a rigid or semi-rigid material or a flexible, reflective film or membrane. In the latter case, the passageway and/or extensions can include end supports that stretch or exert a pulling force on the film or membrane between the ends.

The exemplary passive collimating skylight systems that have been described herein enable many advantages to be attained over known skylighting systems. In addition to being entirely passive, lightweight and low cost, the above-described collimating skylights offer improved efficiency due to the fact that collimation begins immediately upon collection of the light through the energy-receiving aperture above the roof in the dome portion. Further, the skylight systems have multiple features that facilitate installation, including light weight, flexibility and pop-out features. Moreover, use of a metalized polymer film to provide the reflective inner surface of the collimating passageway not only lowers the cost and the weight of the skylight system, but it also results in delivery of a more pleasing "white" light to the area of illumination. Yet further, when sheet metal or other rigid or semi-rigid material is used to form either the entire tapered passageway or the dome portion of the passageway, the geometry of the passageway enables multiple passageways to be stacked upon each other, which provides a tremendous benefit for transporting and delivering the skylight systems to various locations. It is contemplated that the passive collimating skylight systems described herein can include any one or more of these features, alone or in any combination. Passive collimating skylights as taught herein also provide another significant advantage over conventional skylights, i.e., the elimination of glare. By collimating the light that enters the room, the passive collimating skylights eliminate light rays from emerging into the room at high angles above 45 degrees relative to a vertical line. The high angle rays cause glare, which has been shown to reduce the comfort and productivity of the building occupants.

Figure 12:
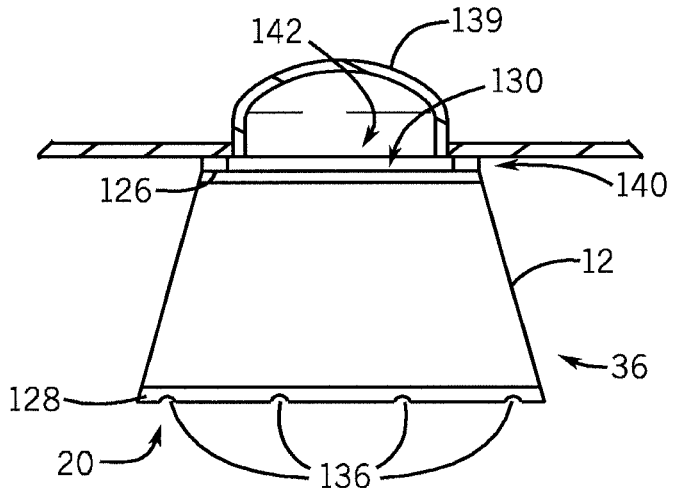
FIG. 12 shows an exemplary collimating passageway used with an existing skylight, according to an illustrative embodiment.

In other embodiments, the portion 36 of the collimating passageway 10 which is installed in the interior of a building may be used without the tapered dome portion 32. As an example and as shown in FIG. 12, the portion 36 may be added to an existing conventional skylight 139, which may be round or square or other shape when viewed from the top, to improve the delivery of light to the working space beneath the skylight by increasing the lumen output and eliminating glare. In FIG. 12, the wall 12 of the portion 36 is made of metalized polymer film and extends between the top end support 126 that defines an upper light-receiving aperture 130 and the bottom end support 128 that defines the light-delivering aperture 20. A fastening system 140 is provided to secure the portion 36 into position so that the portion 36 receives and redirects the light delivered by the existing skylight 139. In some implementations, the fastening system 140 can attach the upper end support 128 to a roof structure so that the upper support 126 generally surrounds the roof aperture 142. In other implementations, the fastening system 140 can be configured to secure the upper support 126 to a portion of the existing skylight 139 that extends into the interior of the building. Regardless of the particular attachment technique, the bottom end support 128 is sufficiently weighted so that it exerts a pulling force on the wall 12 to maintain the shape and position of the passageway portion 32. In the embodiment shown in FIG. 12, the light-receiving aperture 130 and the light-delivering aperture 20 are generally round or square or rectangular, with the light-delivering aperture 20 having a larger area than the light-receiving aperture 130. The wall 12 is conical in shape for a round skylight or has four sides made of sheets of the metalized polymer film for a square or rectangular skylight, where adjacent sides are bonded or adhered together along their vertical edges. Consequently, the shape of the passageway 10 that is maintained by the pulling force exerted on the flexible wall 12 is generally conical for round skylights or pyramidal for square or rectangular skylights. In some embodiments, vertical supports may also be provided that extend along the sides of the wall between the upper end support 126 and the lower end support 128, and the vertical supports may be removable or collapsible so that the portion 32 can be folded or collapsed for transport or storage. The collapsible geometry of FIGS. 7 and 8 can be used for round skylights to form the tapered light shaft 12, or the collapsible geometry of FIGS. 9 and 10 can be used for square or rectangular skylights to farm the tapered light shaft 12.

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A passive skylight system for illuminating an interior space of a building, comprising:

a radiant-energy-collecting window;

a flared edge defining a radiant-energy-delivering aperture;

a wall extending between a first end terminating at the window and a second end terminating at the flared edge, the wall having a specularly reflective inner surface that defines a radiant-energy-directing passageway to redirect radiant energy received by the radiant-energy-collecting window to the radiant-energy-delivering aperture to illuminate the interior space of the building, the inner surface tapering inwardly from the second end to the first end to collimate the radiant energy immediately upon receipt by the radiant-energy-collecting window, a diffuser disposed proximate the radiant-energy-delivering aperture to diffuse radiant energy delivered by the radiant-energy-delivering aperture;

a gasket disposed between the flared edge and the diffuser to seal the radiant-energy-directing passageway from moisture;

a passageway extension having a specularly reflective inner passage way surface, the passageway extension coupled to the radiant-energy-directing passageway to further redirect radiant energy delivered through the radiant-energy-delivering aperture into the interior space of the building wherein the wall includes an outer layer made of sheet metal and an inner layer disposed between the outer layer and the specularly reflective inner surface, the inner layer made of a thermally insulative material;

wherein the radiant-energy-collecting window is disposed at an angle relative to the radiant-energy-delivering aperture;

wherein the specularly reflective inner surface comprises a reflective film;

wherein the passageway extension is defined by a flexible wall that is tapered continuously along its length, and wherein the flexible wall is made of a reflective film.

* * * * *

UNITED STATES PATENT AND TRADEMARK OFFICE

CERTIFICATE OF CORRECTION

PATENT NO. : 9,027,292 B2
APPLICATION NO. : 14/059695
DATED : May 12, 2015
INVENTOR(S) : Mark J. O'Neill et al.

It is certified that error appears in the above-identified patent and that said Letters Patent is hereby corrected as shown below:

Title page, item (72) Inventors:

Delete "Cosa Mesa, TX" Insert --Cosa Mesa, CA--

Signed and Sealed this
Twenty-second Day of March, 2016

Michelle K. Lee

Michelle K. Lee
*Director of the United States Patent and Trademark Office*